US005533227A

United States Patent [19]

Ito et al.

[11] Patent Number: 5,533,227

[45] Date of Patent: Jul. 9, 1996

[54] TOOTHBRUSH

[75] Inventors: Ryu Ito, Kashiwa; Kenji Kaneko, Yokohama; Satoshi Hayashi, Omiya; Akiko Terai, Odawara, all of Japan

[73] Assignee: Lion Corporation, Tokyo, Japan

[21] Appl. No.: 494,008

[22] Filed: Jun. 23, 1995

Related U.S. Application Data

[63] Continuation of Ser. No. 388,906, Feb. 14, 1995, which is a continuation of Ser. No. 76,997, Jun. 15, 1993, abandoned.

[30] Foreign Application Priority Data

Jun. 22, 1992 [JP] Japan ..... 4-048973
Nov. 6, 1992 [JP] Japan ..... 4-321364

[51] Int. Cl.[6] ..... A46B 9/04

[52] U.S. Cl. ..... 15/167.1; 15/207.2

[58] Field of Search ..... 15/191.1, 192, 15/193, 194, 195, 196, 199, 207.2, 167.1; 428/399, 401

[56] References Cited

U.S. PATENT DOCUMENTS

| | | | |
|---|---|---|---|
| 74,560 | 2/1868 | Maury | 15/167.1 |
| 403,542 | 5/1889 | Loonen | 15/199 |
| 1,115,165 | 10/1914 | Briggs | 15/196 |
| 2,273,717 | 2/1942 | Millard et al. | 15/207.2 |
| 2,511,004 | 6/1950 | Peterson . | |
| 3,186,018 | 6/1965 | Shaw | 15/207.2 |
| 3,742,549 | 7/1973 | Scoop et al. | 15/167.1 |
| 3,930,106 | 12/1975 | Mihara et al. | 428/399 |
| 4,081,876 | 4/1978 | Pugh | 15/167.1 |
| 4,724,569 | 2/1988 | Eguchi et al. | 15/167.1 |
| 4,729,142 | 3/1988 | Yoshioka | 15/167.1 |
| 4,738,001 | 4/1988 | Shipp | 15/167.1 |
| 4,766,633 | 8/1988 | Clark | 15/167.1 |

FOREIGN PATENT DOCUMENTS

| | | | |
|---|---|---|---|
| 1185574 | 9/1962 | Germany . | |
| 90 12 603.3 | 9/1990 | Germany . | |
| 47618 | 12/1972 | Japan | 428/399 |
| 51744 | 5/1981 | Japan | 15/207.2 |
| 57-12934 | 1/1982 | Japan . | |
| 57-65632 | 4/1982 | Japan . | |
| 239518 | 11/1985 | Japan | 428/399 |
| 2243871 | 10/1987 | Japan | 428/399 |
| 598821 | 2/1948 | United Kingdom | 15/207.2 |

*Primary Examiner*—David Scherbel
*Assistant Examiner*—Tony G. Soohoo
*Attorney, Agent, or Firm*—Price, Gess & Ubell

[57] ABSTRACT

A toothbrush capable of permitting tips of fillings thereof to enter or reach areas such as recesses between teeth, boundaries between teeth and gingivae, and the like to effectively remove dental plaque and the like and exhibit a soft feeling sufficient to prevent damage to gingivae. The toothbrush includes fillings made of a synthetic filament material. The fillings are each formed at both tips thereof into a pointed tapered shape and tied up into a plurality of bundles. The pointed tapered tips of the fillings are each formed with a length of 4 to 8 mm and a non-tapered section of each of the fillings is formed with a maximum diameter of 0.16 to 0.20 mm. Filling setting holes of a filling setting base provided at distal end of a handle of the toothbrush so as to set the bundles of the fillings thereon are formed with a diameter of 1.5 to 2.0 mm and spaced from other holes at an interval of 1.0 to 1.2 mm in the longitudinal direction of the handle.

6 Claims, 3 Drawing Sheets

TOOTHBRUSH

This is a continuation of application U.S. Ser. No. 08/388,906, filed on Feb. 14, 1995, which is a continuation of U.S. Ser. No. 08/076,997, filed on Jun. 15, 1993 (abandoned).

BACKGROUND OF THE INVENTION

1. Field of the Invention

This invention relates to a toothbrush, and more particularly to a toothbrush capable of exhibiting a high cleaning function sufficient to effectively remove hard to remove dental plaque which tends to readily accumulate at areas such as recesses between teeth, boundaries between teeth and gingivae and the like and capable of feeling soft to the gingivae to a degree sufficient to exhibit excellent usability.

2. Description of the Prior Art

In order to protect teeth and gingivae from periodontal diseases and dental caries, which are called the two major dental diseases, it is essential to remove dental plaque by means of a toothbrush. For this purpose, it has been recently recognized that cleaning of teeth which is carried out by using tips of the fillings of a toothbrush is effective for removing dental plaque, such a way of brushing being called scrubbing, the Bass technique or the like.

In a toothbrush using fillings made of a synthetic filament material, the fillings are each formed of a soft material into a thin shape in order to prevent tips of the fillings from damaging gingivae during cleaning by brushing such as the Bass technique or the like. Such fillings feel soft to a user, however, they fail to exhibit rigidity and/or stiffness sufficient to permit dental plaque to be effectively removed, as well as satisfactory durability.

Also, a toothbrush of another type is proposed, which is constructed in such a manner that tips at both ends of each of the fillings are each formed into a tapered shape so as to permit the tips of the fillings to enter or reach areas such as recesses between teeth, boundaries between teeth and gingivae, and the like. Unfortunately, a length of the tapered tips of the fillings thus provided is as small as about 1 mm, so that the toothbrush fails to significantly improve both a cleaning function and a soft feeling exhibited to a user thereof. Thus, the tapered tips of the fillings fail to exhibit advantages over conventional fillings of which the tips are rounded.

Further, it is known that fillings each having tips formed into a pointed tapered shape of an increased length by chemical treatment are used for various kinds of brushes such as painting brushes, cosmetic brushes, face washing brushes and the like, as taught in Japanese Utility Model Application Laid-Open Publications Nos. 12934/1982 and 65632/1982. In various kinds of brushes disclosed in each of the above Japanese publications, fillings of which the tips are each formed into a pointed tapered shape are used in place of conventional fillings exclusively made of natural animal hairs, to thereby improve feeling properties of the brush, its durability, its sanitary properties and the like. However, the toothbrush including the pointed tapered fillings is substantially inferior in cleaning performance to a conventional toothbrush having non-tapered fillings set thereon, because the tapered fillings are excessively soft or flexible owing to a improper tapered shape. In order to solve the problem, it is required to provide the fillings with suitable hardness by increasing a maximum diameter of the fillings. Unfortunately, this causes the pointed tapered tips of the fillings to be so hard to damage gingivae.

SUMMARY OF THE INVENTION

The present invention has been made in view of the foregoing disadvantage of the prior art.

Accordingly, it is an object of the present invention to provide a toothbrush which is capable of exhibiting a significantly improved tooth cleaning effect.

It is another object of the present invention to provide a toothbrush which is capable of preventing damage to teeth and gingivae during cleaning thereof.

It is a further object of the present invention to provide a toothbrush which is capable of effectively cleaning areas such as recesses between teeth, boundaries between teeth and gingivae, and the like.

It is still another object of the present invention to provide a toothbrush including fillings made of a synthetic filament material which are capable of permitting the toothbrush to accomplish the above-described objects while exhibiting a soft feeling and excellent usability to a user thereof.

In accordance with a first aspect of the present invention, a toothbrush is provided. The toothbrush includes fillings made of a synthetic filament material and a handle provided at a distal end thereof with a filling setting base. Each of the fillings is formed at a tip thereof into a pointed tapered shape and the fillings are tied up into a plurality of bundles. The filling setting base is formed with filling setting holes in which the bundles of the fillings are set so as to permit the pointed tapered tip of each of the fillings to be outwardly projected therefrom. The filling setting holes are arranged in a plurality of rows in parallel to a longitudinal direction of the handle.

In the toothbrush of the present invention generally constructed as described above, the pointed tapered tip of each of the fillings is formed with a length of 4 to 8 mm, a non-tapered section of each of the fillings is formed with a maximum diameter of 0.16 to 0.20 mm and each of the filling setting holes is formed with a diameter of 1.5 to 2.0 mm and spaced from other holes at an interval of 1.0 to 1.2 mm in the longitudinal direction of the handle.

In a preferred embodiment of the present invention, the pointed tapered tip of each of the fillings may be formed with a length of 4 to 7 mm, the non-tapered section of each of the fillings is formed with a maximum diameter of 0.17 to 0.18 mm, and each of the filling setting holes may be formed with a diameter of 1.5 to 1.9 mm and spaced from other holes at an interval of 1.0 to 1.2 mm in the longitudinal direction of the handle.

In accordance with a further aspect of the present invention, a toothbrush is provided. The toothbrush includes fillings made of a synthetic filament material and handle provided at a distal end thereof with a filling setting base. Each of the fillings is formed at a tip thereof into a tapered shape and the fillings are tied up into a plurality bundles. The filling setting base is formed with filling setting holes in which the bundles of the fillings are set so as to permit the tapered tip of each of the fillings to be outwardly projected therefrom. The filling setting holes are arranged in at least one row parallel to a longitudinal direction of the handle. In the toothbrush, the tapered tip of each of the fillings is formed into a shape defined by diameters of the tapered tip of the filling at distances of 1 mm, 3 mm, 5 mm and 8 mm from a tip end of the filling, the diameters being set in the ranges of 25 to 35%, 55 to 70%, 80 to 90% and 90 to 100% of a diameter of a proximal section of the filling, respectively.

In a preferred embodiment of the present invention, the fillings may have a stiffness represented by calculated values from deflection forces at distances of 1 mm, 3 mm, 5 mm and 8 mm from the tip ends of said fillings, the calculated values being 0.5 to 2.0N/mm$^2$, 2.5 to 4.5N/mm$^2$, 3.5 to 5.5N/mm$^2$ and 6 to 15N/mm$^2$, respectively, as measured and calculated according to the International Standard ISO 8627.

BRIEF DESCRIPTION OF THE DRAWINGS

These and other objects and many of the attendant advantages of the present invention will be readily appreciated as the same becomes better understood by reference to the following detailed description when considered in connection with the accompanying drawings in which like reference numerals designate like or corresponding parts throughout; wherein.

DETAILED DESCRIPTION OF THE PREFERRED EMBODIMENT

Now, a toothbrush according to the present invention will be described hereinafter with reference to the accompanying drawings.

Figure 1:
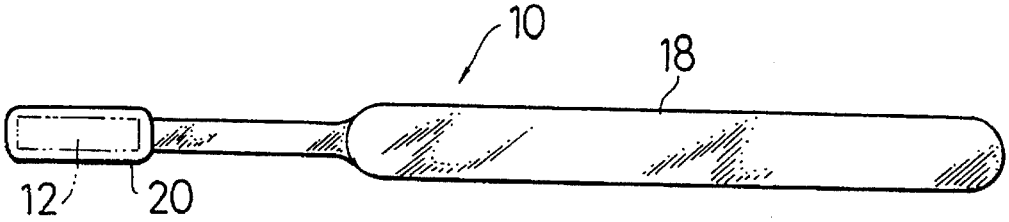
FIG. 1 is a plan view showing an embodiment of a toothbrush according to the present invention.
Figure 2:
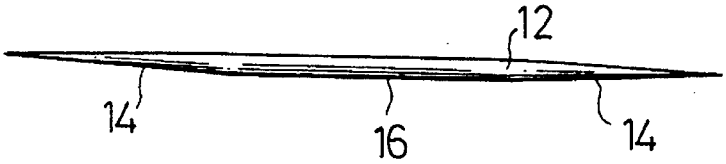
FIG. 2 is a side elevation view showing an example of one of fillings incorporated in a toothbrush according to the present invention.
Figure 3:
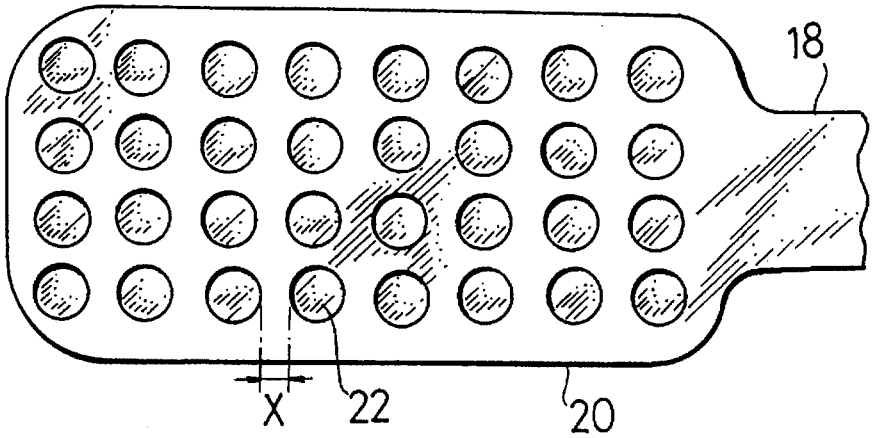
FIG. 3 is a fragmentary enlarged plan view showing a filling setting base of the toothbrush shown in FIG. 1 on which the fillings are set.

Referring to FIGS. 1 to 4 and FIG. 7, an embodiment of a toothbrush according to the present invention is illustrated. A toothbrush of the illustrated embodiment generally designated at reference numeral 10 in FIG. 1 includes fillings 12. The fillings 12 are made of a synthetic filament material such as polyester, polyamide, polypropylene, other polyolefins, or the like. The fillings 12, as shown in FIG. 2, are each formed at both tips thereof into a pointed tapered shape as indicated at reference numeral 14. Each of the pointed tapered tips 14 has a length of 4 to 8 mm, and preferably 4 to 7 mm. Also, each of the fillings 12 includes a non-tapered intermediate section or proximal section 16 interposedly arranged between both pointed tapered tips 14. The non-tapered intermediate section 16 is formed into a maximum diameter of 0.16 to 0.20 mm, and preferably 0.17 to 0.18 mm. The toothbrush also includes a handle 18 made of a suitable synthetic resin material such as polypropylene, AS resin or the like. The handle 18 is provided at a distal end thereof with a filling handle 18 is provided at a distal end thereof with a filling setting base 20 as shown in FIGS. 1 and 3. The filling setting base 20 is formed thereon with a plurality of filling setting holes 22.

Figure 4:
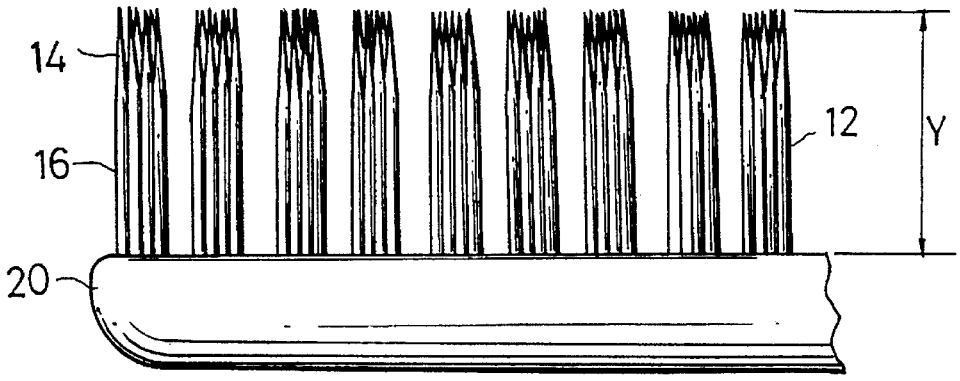
FIG. 4 is a fragmentary enlarged side elevation view showing the fillings set on the filling setting base of FIG. 3.

A plurality of the fillings 12 formed as described above are tied up into a plurality of bundles and then each bundle is formed into a U-shape by bending a central portion thereof. The bent central portions of the respective filling bundles are set in the corresponding filling setting holes 22, resulting in the toothbrush being fabricated as shown in FIG. 4.

The filling setting holes 22 are each formed into a diameter of 1.5 to 2.0 mm, and preferably 1.5 to 1.9 mm. Also, the holes 22 are arranged in a plurality of rows in parallel to a longitudinal direction of the handle 18 in such a manner that intervals X between the holes 22 in the longitudinal direction of the handle 18 are set to be 1.0 to 1.2 mm. The fillings 12 bundled and bent as described above are set in the holes 22 so that the length Y of each of the fillings 12 is 10 to 12 mm as in the conventional toothbrush (FIG. 4).

The above-described construction of the present invention was achieved after a number of experiments performed by the inventors. If the pointed tapered tips 14 have a length exceeding 8 mm, the rigidity and/or stiffness of the fillings 12 will be reduced to a degree sufficient to cause the cleaning performance of the fillings 12 to be significantly deteriorated, whereas a length less than 4 mm causes the fillings 12 to feel unsoft to the gingivae and makes it difficult for the tips 14 of the fillings 12 to enter or reach areas such as recesses formed between teeth, boundaries between teeth and gingivae, and the like, resulting in the fillings 12 failing to exhibit a satisfactory cleaning action. When the non-tapered intermediate sections 16 of the fillings 12 have a maximum diameter exceeding 0.20 mm, the tips 14 of the fillings stimulate the gingivae, leading to a possibility, depending on the manner of cleaning with the toothbrush, that the gingivae will be damaged; whereas a maximum diameter less than 0.16 mm causes the fillings 12 to fail to exhibit rigidity and/or stiffness sufficient to permit the pointed tapered tips 14 of the fillings to exhibit a satisfactory cleaning function.

If the filling setting holes 22 have a diameter exceeding 2.0 mm, the bundles of the fillings will have to be excessively increased in diameter, resulting in it being difficult for the tips 14 of the fillings to reach or enter areas such as recesses between teeth, boundaries between teeth and gingivae, and the like. Also, such a diameter of the holes 22 causes the fillings 12 to feel unsoft to the gingivae. On the other hand, a diameter less than 1.5 mm causes a cleaning action of the fillings to deteriorate and the tips 14 of the fillings 12 to be readily deformed or bent into a tulip-like shape, leading to the tips losing their utility.

When the intervals X between filling setting holes 22 in the longitudinal direction of the handle 18 are more than 1.2 mm, the bundles of the fillings are decreased in density, so that the cleaning action of the toothbrush is significantly deteriorated. On the other hand, intervals below 1.0 mm cause the density of the bundles to be excessively increased, to thereby make it difficult for the tips 14 of the fillings 12 to reach or enter areas such as recesses between teeth, boundaries between teeth and gingivae, and the like and deteriorate the productivity and utility of the toothbrush. Intervals between the filling setting holes 22 in directions other than the longitudinal direction of the handle 18 may be suitable set as in the prior art.

The length of the pointed tapered tips 14 of the fillings 12, the maximum diameter of the non-tapered intermediate section 16 of the fillings 12, the diameter of the filling setting holes 22, and the intervals X between the filling setting holes 22 in the longitudinal direction of the handle 18 in the toothbrush of the present invention which are set as described above permit the fillings 12 to exhibit a softness similar to the softness of the hair of such animals as a horse, a goat and the like. Also, the above-described maximum diameter of the non-tapered intermediate section 16 of the fillings 12 which are to be set in each of the filling setting holes 22 permits the fillings set in the holes 22 to exhibit satisfactory rigidity and/or stiffness. Further, in the illustrated embodiment, the fillings 12 are bundled to have a thickness sufficient to permit the fillings to readily enter areas such as recesses between teeth, boundaries between teeth and gingivae, and the like. Thus, it will be noted that the toothbrush of the illustrated embodiment permits dental plaque, which the conventional toothbrush failed to remove, to be effectively removed while also preventing gingivae from being damaged.

Figure 5:
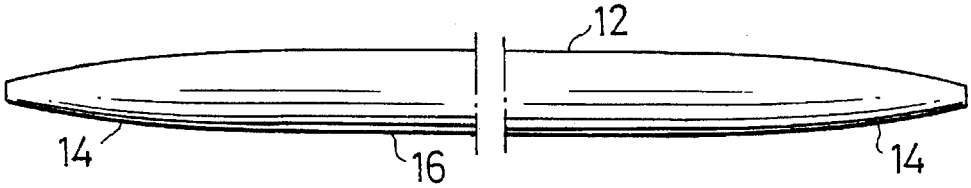
FIG. 5 is a side elevation view showing another example of one of fillings according to the present invention.
Figure 6:
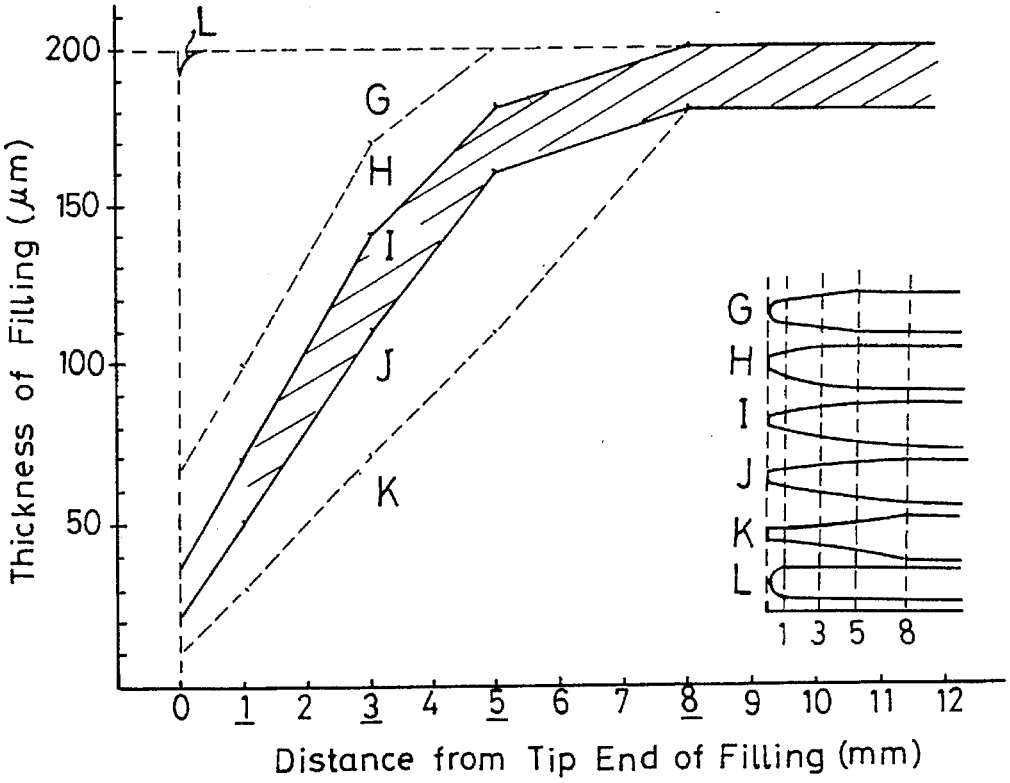
FIG. 6 is a graphical representation showing the relation between diameters of a tapered tip and distances from a tapered tip end in each of fillings having tips of different tapered shapes.
Figure 7:
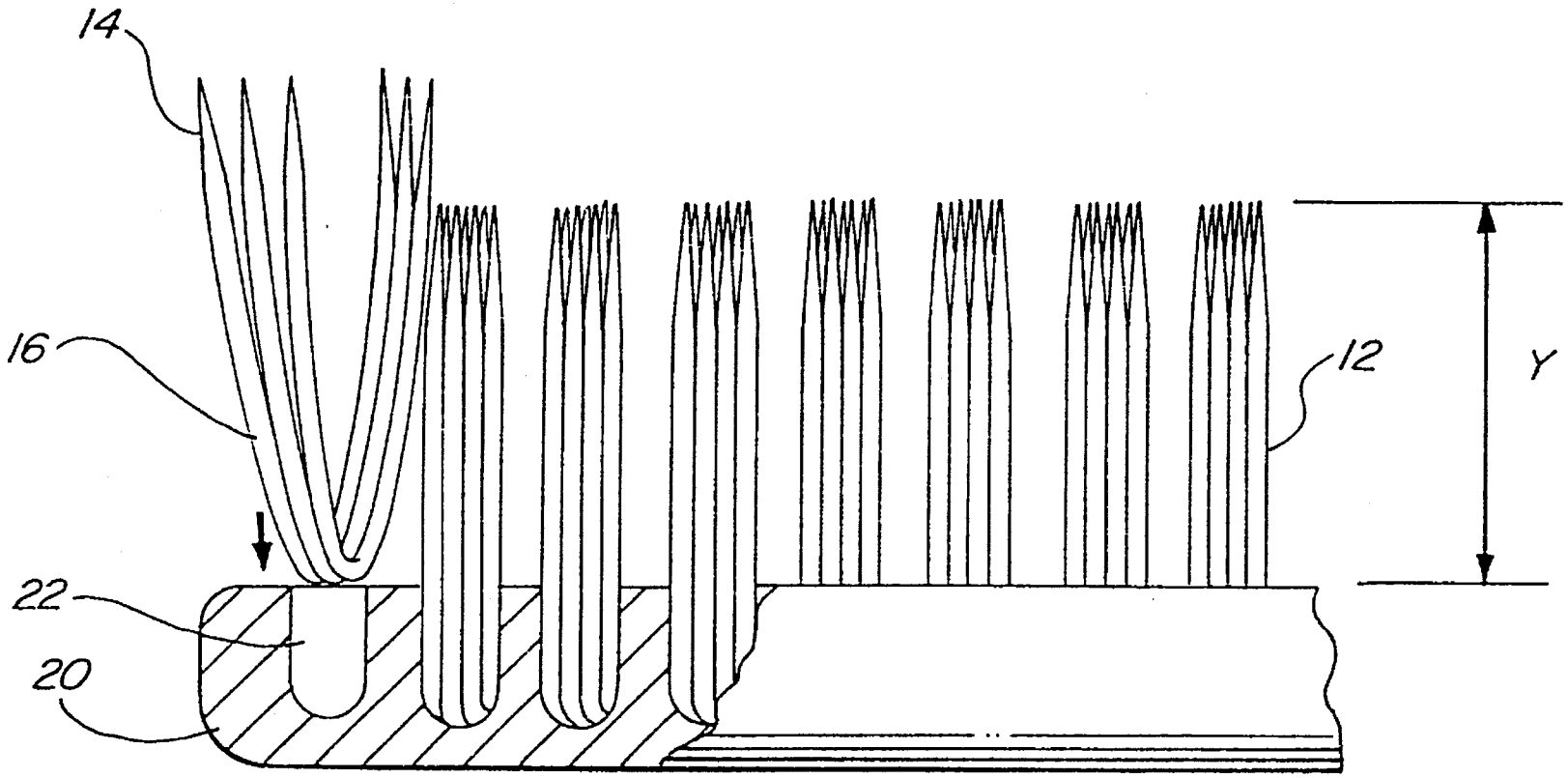
FIG. 7 is a partially cutaway and exploded view of FIG. 4.

Referring to FIG. 5 and 6, another embodiment of fillings of a toothbrush according to the present invention is illustrated. The fillings 12 are made of a synthetic monofilament such as polyester, polyamide, other polyolefins, or the like. The fillings 12, as shown in FIG. 5, are each formed at both tips thereof into a predetermined pointed tapered shape as indicated by reference numeral 14. Each of the pointed tapered tips 14 is formed into a shape defined by diameters of the tapered tip 14 of the filling 12 at distances of 1 mm, 3 mm, 5 mm and 8 mm from a tip end of the filling 12, which diameters are set in the ranges of 25 to 35%, 55 to 70%, 80 to 90% and 90 to 100% of a diameter of the proximal section 16 of the filling 12, respectively. Each of the pointed tapered tips 14 has a length of 8 to 15 mm, and preferably 8 to 10 mm. A central proximal section 16 of each of the fillings 12 is formed into a maximum diameter of 0.15 to 0.25 mm, and preferably 0.17 to 0.20 mm.

A plurality of the fillings 12 formed as described above are tied up into a plurality of bundles and then each bundle is doubled over at a central portion thereof. The central portions of the respective fillings bundles are set in the corresponding filling setting holes 22, resulting in the toothbrush being fabricated as shown in FIG. 4.

In this embodiment, the fillings setting holes 22 are each formed into a diameter of 1.5 to 2.2 mm, and preferably 1.5 to 1.9 mm. The holes 22 are arranged in a plurality of rows, for example 2 to 4 rows, parallel to a longitudinal direction of the handle 18. The intervals X between the holes in the longitudinal direction of the handle 18 are set to be 1.0 to 1.4 mm. The length Y of each of the fillings 12 set in the holes 22 as described above is 10 to 13 mm as in the conventional toothbrush.

The present invention will be understood more readily with reference to the following examples; however, these examples are intended to merely illustrate the invention and are not to be construed as limiting the scope of the invention.

EXAMPLE 1

Toothbrush specimens shown in Table 1 were prepared for a comparative test of cleaning capability. The toothbrush specimens were made in such a manner that the filling setting holes 22 wherein the fillings with tapered tips are set of the filling setting base 20 provided at the distal end of the handle made of polypropylene each had a diameter of 1.5 mm and the intervals X between the filling setting holes 22 in a longitudinal direction of the handle 18 were set to be 1.0 mm.

TABLE 1

Toothbrush Specimens Used for Evaluation of Cleaning Capability

| Tooth-brush | Filling Material | Maximum Diameter (mm) | Length (Y) of Filling (mm) | Processing of Tip of Filling |
|---|---|---|---|---|
| A | Thermoplastic Polyester Filament | 0.18 | 11 | Alkali-Treated Taper Taper Length: 5 mm |
| B | Thermoplastic Polyester Filament | 0.18 | 11 | Alkali-Treated Taper Taper Length: 11 mm |
| C | Nylon Filament | 0.20 | 11 | Rounded by Filing |
| D | Nylon Filament | 0.20 | 11 | Formation of Taper by Filing Taper Length: 1 mm |
| E | Nylon Filament | 0.13 | 11 | Formation of Taper by Filing Taper Length: 1 mm |
| F | Hair (Horse) | <0.13 | 11 | Formation of Taper by Filing Taper Length: 1 mm |

The cleaning capability of each of the toothbrush specimens tested was evaluated according to the following procedure.

Fifteen persons were selected as subjects. The toothbrush specimens were tested by the subjects over a total period of time of six weeks, each of the specimens being respectively tested, in an order from specimen A to specimen F, for one week. Also, the degree of removal of dental plaque resulting from use of each of the toothbrush specimens was measured each week.

The degree of removal of dental plaque due to use of each of the toothbrush specimens was measured according to the following procedure.

On the first day, the tartar and dental plaque were fully removed from the tooth of each of the subjects and then use of the toothbrush specimens was commenced. On the sixth day, the cleaning was interrupted to allow dental plaque to accumulate on the teeth of the subjects. On the seventh day, the amount of dental plaque accumulated was measured and then brushing by the toothbrush specimen was carried out to measure the amount of dental plaque remaining on the teeth after brushing again. Then, the difference between the amount of dental plaque before the cleaning on the seventh day and that after the cleaning was divided by the amount of dental plaque obtained before the cleaning, resulting in obtaining degrees of removal of dental plaque by use of each of the toothbrush specimens in the form of percentages.

In the example, six teeth of which positions are shown in Table 2 were chosen as the object for the test from a set of teeth. The six teeth of each of the subjects selected were found to be healthy. The results were as shown in Table 3.

TABLE 2

Positions of Tested Teeth

| | |
|---|---|
| 6 | 14 |
| 41 | 6 |

TABLE 3

| Toothbrush | Degree of Removal of Dental Plaque by Toothbrush Specimens (%) Position of Tooth 6\|6 | 4\|4 | 1\|1 | Average |
|---|---|---|---|---|
| A | 65 | 68 | 73 | 69 |
| B | 41 | 43 | 56 | 47 |
| C | 50 | 61 | 63 | 58 |
| D | 52 | 58 | 62 | 57 |
| E | 40 | 42 | 54 | 45 |
| F | 38 | 44 | 53 | 45 |

As can be seen from Table 3, the toothbrush specimen A achieved a cleaning performance superior to those of the toothbrush specimens E and F wherein fillings were made of a fine filament material, the toothbrush specimens C and D having a conventional "normal" hardness, and the toothbrush B wherein the fillings were tapered along the whole length thereof.

EXAMPLE 2

This example was carried out to determine at which degree of thickness of the fillings having pointed tapered tips and at which length of the tapered tips gingivae were stimulated (pricked).

Toothbrush specimens which included a filling setting base provided at a distal end of a handle as in Example 1 described above and fillings of thermoplastic polyester filament, having tapered tips of different lengths and maximum diameter sections of different thicknesses set in the filling setting base, were prepared and applied to fifteen persons selected as subjects of this experiment for determining at which degree of thickness of the fillings having pointed tapered tips and at which length of the tapered tips gingivae were stimulated. The results were as shown in Table 4.

TABLE 4

Effects of Thicknesses of Fillings and Lengths of Tapered Tips thereof on Stimulus to Gingivae

| Thickness of Maximum Diameter Section (mm) | Length of Tapered Tip (mm) 2 | 4 | 6 | 8 | 10 |
|---|---|---|---|---|---|
| 0.24 | X | X | X | Δ | Δ |
| 0.22 | X | X | Δ | Δ | ○ |
| 0.20 | X | Δ | ○ | ○ | ○ |
| 0.18 | Δ | ○ | ○ | ○ | ○ |
| 0.16 | Δ | ○ | ○ | ○ | ○ |
| 0.14 | ○ | ○ | ○ | ○ | ○ |

Criteria for Evaluation: Ratio of subjects who felt stimulus to all subjects
○ — 0/15
Δ — 1 to 5/15
X — 6 or more/15

As indicated in Table 4, when the thickness of the maximum diameter section of the fillings was 0.22 mm or less, the effect of the thickness of the maximum diameter section of the fillings on stimulus to gingivae was partially or fully prevented, depending on the lengths of the tapered tip, while thicknesses of 0.14 mm or less fully prevented the fillings from stimulating gingivae irrespective of lengths of the tapered tips.

In addition, a cleaning test was carried out using toothbrush specimens having fillings with tapered tips of different lengths and maximum diameter sections of different thickness and conventional toothbrush specimens with fillings having non-tapered tips.

The test was carried out using model jaws of a standard size on which teeth were detachably mounted. In the test, the teeth were coated with model dental plaque made by dissolving a water-soluble polymer red coloring matter in water in such a manner that the model dental plaque reached the root of each of the teeth. Then, the coated teeth were mounted on the model jaws and each of the teeth in the same positions as in Table 2 were cleaned ten times by brushing according to the Bass technique using the toothbrush specimens. Thereafter, a position of a gingival edge of the model jaws to which each of the teeth positionally corresponds was marked and then the teeth were removed from the model jaws to evaluate a depth to which the model dental plaque submarginal relating to the gingival edge of each of the teeth was removed. The results were as shown in Table 5.

TABLE 5

Effects of Thicknesses of Fillings and Lengths of Tapered Tips on Cleaning Performance, and Cleaning Capability of Non-tapered Fillings

| Thickness of Maximum Diameter Section (mm) | Length of Tapered Tip (mm) 0 (Non-tapered Rounded Tip) | 2 | 4 | 6 | 8 | 10 |
|---|---|---|---|---|---|---|
| 0.24 | X | X | Δ | ○ | ○ | Δ |
| 0.22 | X | X | Δ | ○ | Δ | X |
| 0.20 | X | X | ○ | ○ | Δ | X |
| 0.18 | X | X | ○ | ○ | Δ | X |
| 0.16 | X | Δ | ○ | Δ | X | X |
| 0.14 | X | X | X | X | X | X |

Criteria for Evaluation:
○ : Removal of submarginal dental plaque to depth of 1.5 mm or more
Δ: Removal of submarginal dental plaque to depth of 0 to 1.5 mm
X: Removal of only surpramarginal dental plaque As indicated in Table 5, the effect of lengths of the tapered tips on the cleaning capability of the toothbrush varied depending on the thicknesses of the maximum diameter sections. More particularly, when the thickness of the maximum diameter section was 0.20 mm, which was most typical, the tapered tips having a length of between 4 mm and 8 mm had good cleaning capability, while the tapered tips having a length of 10 mm or more failed to exhibit good cleaning capability. This is because an excessive decrease in the lengths of the tapered tips causes the fillings to fail to exhibit flexibility, resulting in it being difficult for the tips of the fillings to enter narrow recesses submarginal relating to an edge of gingivae, whereas an excessive increase in the length of the tapered tips causes rigidity and/or stiffness of the fillings to deteriorate, so that the fillings fail to satisfactorily exhibit a function for cleaning the above recesses.

Thus, the results shown in Tables 4 and 5 indicate that a combination of a thickness of the maximum diameter section between 0.16 mm and 0.20 mm and a length of the tapered tips between 4 mm and 8 mm prevents the fillings from stimulating gingivae and permits the fillings to exhibit a satisfactory cleaning effect.

EXAMPLE 3

This example was carried out to observe the effects of the diameter of the filling setting holes and intervals between the filling setting holes in a longitudinal direction of a handle in a toothbrush including fillings having pointed tapered tips, on a cleaning action of the fillings.

For this purpose, toothbrush specimens were prepared which included fillings formed with pointed tapered tips, and filling setting holes provided in four rows in such a manner as shown in FIG. 3, the diameters of the holes and intervals between the holes being different. The fillings were made of a thermoplastic polyester filament material and each one had a length of 11 mm, a thickness of a maximum diameter section of 0.18 mm, and a tapered tip having a length of 5 mm. Also, in the example, the same model jaws as used in Example 2 were used and the same procedure as in Example 2 was repeated to evaluate the degree to which model dental plaque submarginal relating to an edge of gingivae was removed. The results were as shown in Table 6.

TABLE 6

Effects of Diameter of Filling Setting Holes and Intervals between Filling Setting Holes on Cleaning Action

| Diameter of Holes (mm) | Interval between Holes (mm) 0.8 | 1.0 | 1.2 | 1.4 | 1.6 |
|---|---|---|---|---|---|
| 1.4 | X | X | X | X | X |
| 1.5 | X | ○ | Δ | X | X |
| 1.6 | X | ○ | ○ | X | X |
| 1.7 | X | ○ | ○ | X | X |
| 1.8 | X | ○ | ○ | X | X |
| 1.9 | X | Δ | ○ | X | X |
| 2.0 | X | Δ | Δ | X | X |
| 2.1 | X | X | X | X | X |

Criteria for Evaluation:
○ : Uniform removal of model dental plaque
Δ: Slight amount of model dental plaque
X: Strips of plaque remaining As indicated in Table 6, the toothbrush specimens having filling setting holes with diameters of 1.5 to 2.0 mm and intervals of 1.0 to 1.2 mm arranged between exhibited an excellent cleaning effect so that model dental plaque submarginal relating to an edge of gingivae was effectively removed, the conventional non-taper toothbrush having, by contrast, failed to remove such plaque. However, intervals between the filling setting holes which were 1.4 mm or more or 0.8 mm or less failed to permit the fillings to exhibit a satisfactory cleaning effect. The reason why is that when the intervals are 1.4 mm or more, density of the bundled fillings is reduced to such a degree that removal of the plaque becomes difficult; whereas the intervals of 0.8 mm or less cause the density of the bundled fillings to be excessively increased to substantially prevent the tips of the fillings from entering submarginal recesses.

In connection with an effect of a diameter of the filling setting holes on a cleaning action of the fillings, the diameter of 1.4 mm or less and 2.1 mm or more failed to permit the fillings to exhibit a satisfactory cleaning function. The reason why is that the diameter of 1.4 mm or less causes the bundled fillings to be excessively reduced in rigidity and/or stiffness so they lose the capability of removing the plaque, whereas the diameter of 2.1 mm or more causes a diameter of the bundled fillings to be excessively increased to prevent the tips of the fillings from entering the submarginal recesses.

EXAMPLE 4

Toothbrush specimens shown in Table 7 were prepared for a comparative test of cleaning capability. The toothbrush specimens were made in such manner that the filling setting holes 22 arranged in four rows had a diameter of 1.6 mm and the intervals X between the filling setting holes 22 in a longitudinal direction of the handle 18 were set to be 1.2 mm. In the toothbrush specimens, the fillings 12 made of a synthetic monofilament material each included a proximal section 16 having a diameter of 200 μm and a length Y of the fillings was 11 mm.

TABLE 7

Toothbrush Specimens Having Fillings with Tips of Different Tapered Shapes Used for Evaluation of Cleaning Capability

| Tooth-brush | Diameter of Filling at Distance from Tip End (μm) Distance from Tip End 1 mm | 3 mm | 5 mm | 8 mm |
|---|---|---|---|---|
| G | ≧100 (≧50%) | ≧170 (≧85%) | 200 (100%) | 200 (100%) |
| H | 70–100 (35–50%) | 140–170 (75–85%) | 180–200 (90–100%) | 180–200 (90–100%) |
| I | 50–70 (25–35%) | 110–140 (55–70%) | 160–180 (80–90%) | 180–200 (90–100%) |
| J | 30–50 (15–25%) | 70–110 (35–55%) | 110–160 (55–80%) | 180–200 (90–100%) |
| K | ≦30 (≦15%) | ≦70 (≦35%) | ≦110 (≦55%) | ≦180 (≦90%) |
| L* | 200 (100%) | 200 (100%) | 200 (100%) | 200 (100%) |

Values in parentheses are the ratio of the diameters of the tapered tips to the diameters of the respective proximal sections of the fillings.
*The toothbrush specimen L was a conventional one which had fillings with tips rounded by filing.

The cleaning capability of each of the toothbrush specimens tested was evaluated according to the same procedure as in Example 1 described above. The results were as shown in Table 8.

TABLE 8

Degree of Removal of Dental Plaque by Toothbrush Specimens (%) Position of Tooth

| Toothbrush | 6\|/6 | \|4/4 | \|1/1 | Average |
|---|---|---|---|---|
| G | 58 | 55 | 64 | 59 |
| H | 62 | 60 | 67 | 63 |
| I | 69 | 72 | 78 | 73 |
| J | 54 | 61 | 65 | 60 |
| K | 51 | 53 | 53 | 52 |
| L | 49 | 62 | 63 | 58 |

As can be seen from Table 8, the tooth specimen I achieved a cleaning performance superior to those of the toothbrush specimens G and H wherein fillings were formed with thicker tapered tips, the toothbrush specimens J and K wherein fillings were formed with thinner tapered tips, and the toothbrush specimen L having fillings with conventional rounded tips.

Also, the same toothbrush specimens as in the table 8 were prepared and applied to fifteen persons selected as subjects for determining by what shape of the pointed tapered tips gingivae were stimulated (pricked). The results were as shown in Table 9.

TABLE 9

| Toothbrush | G | H | I | J | K | L |
|---|---|---|---|---|---|---|
| Evaluation | X | Δ | ○ | ○ | ○ | ○ |

Effects of Shapes of Tapered Tips of Fillings on Stimulus to Gingivae

Criteria for Evaluation: Ratio of subjects who felt stimulus to all subjects
○ — 0/15
Δ — 1 to 5/15
X — 6 or more/15

In addition, a durability test was carried out using the toothbrush specimens according to the following procedure.

The toothbrush specimens each were moved 20000 cycles with a stroke of 3 cm in warm water at a temperature of 35° C. while the fillings thereof being kept in contact with an rough surface of a plate with a load of 500 gf. After this operation, the evaluation of the durability of the fillings was carried out by observing the degree of spread of the fillings. The results were as shown in Table 10.

TABLE 10

| Toothbrush | G | H | I | J | K | L |
|---|---|---|---|---|---|---|
| Evaluation | ○ | ○ | ○ | Δ | X | ○ |

Effects of Shapes of Tapered Tips of Fillings on Durability

Criteria for Evaluation:
○ : Tips of fillings being excessively spread out, the toothbrush cannot be used any more.
Δ: Tips of fillings being relatively spread out, the toothbrush can be used a few more.
X: Tips of fillings being slightly spread out, the toothbrush can still be used further 10000 cycles.

As can been seen from Tables 8 to 10, the shape of the tapered tips of fillings like that of the toothbrush specimen I is practical and useful.

EXAMPLE 5

This example was carried out to determine which degree of stiffness of the fillings at predetermined points, which fillings had pointed tapered tips, was practical and useful. Stiffnesses of the fillings at the predetermined points were obtained by measuring deflection forces at the predetermined points on the tapered tips and calculating them according to the International Standard ISO 8627. The results were as shown in Table 11. In this case, experimental points on the tapered tips of the filling were set to be at distances of 1 mm, 3 mm, 5 mm and 8 mm from the tip ends of the fillings. The toothbrush specimens were each fixed so that the experimental points might be flush with a plane formed by parallel wires in a measuring apparatus. Then, horizontal deflection forces or reaction forces caused by the deflection of the fillings were measured when the filling setting base was moved across the wires. The measurement was carried out under the following conditions and the mean value of the stiffness was calculated:

dry: the toothbrush specimens were each tested within five (5) minutes after being kept at a temperature of 20°±1° C. and a relative humidity of 65±2% for 24 hours;

wet: the toothbrush specimens were each tested within five (5) minutes after being immersed in water at 20°±1° C. for 24 hours.

TABLE 11

Deflection Forces at Positions on Fillings of Toothbrush Specimens Having Fillings with Tips of Different Tapered Shapes (N/mm$^2$)

| Tooth-brush | Experimental Positions on Fillings Distance from Tip End | | | |
|---|---|---|---|---|
| | 1 mm | 3 mm | 5 mm | 8 mm |
| M | 3.0–4.0 | 5.5–7.0 | 7.5–8.0 | 14.0–15.0 |
| N | 2.0–3.0 | 4.5–5.5 | 5.5–7.0 | 6.0–15.0 |
| O | 0.5–2.0 | 2.5–4.5 | 3.5–5.5 | 6.0–15.0 |
| P | 0.3–0.5 | 1.5–2.5 | 2.5–3.5 | 6.0–15.0 |
| Q | 0–0.3 | 0.5–1.5 | 1.5–2.5 | 4.0–6.0 |

In this example, the toothbrush specimens having fillings made of a polyester resin monofilament material were tested to observe the cleaning capability, stimulus to gingivae and durability of the toothbrush specimens, likewise respectively. The results were as shown in Tables 12, 13 and 14.

TABLE 12

Degree of Removal of Dental Plaque by Toothbrush Specimens (%)

| Toothbrush | 6\|/6 | \|4/4 | \|1/1 | Average |
|---|---|---|---|---|
| M | 55 | 53 | 62 | 57 |
| N | 60 | 61 | 66 | 62 |
| O | 71 | 70 | 76 | 72 |
| P | 55 | 60 | 67 | 61 |
| Q | 49 | 54 | 55 | 53 |

Position of Tooth

The criteria for evaluation were the same as described.

TABLE 13

| Toothbrush | M | N | O | P | Q |
|---|---|---|---|---|---|
| Evaluation | X | Δ | ○ | ○ | ○ |

Effects of Stiffness of Tapered Tips of Fillings on Stimulus to Gingivae

The criteria for evaluation were the same as described.

TABLE 14

| Toothbrush | M | N | O | P | Q |
|---|---|---|---|---|---|
| Evaluation | ○ | ○ | ○ | Δ | X |

Effects of Stiffness of Tapered Tips of Fillings on Durability

The procedure of testing was the same as described.

Tables 12 to 14 indicate that the toothbrush specimen O is more practical and useful than others.

Though 100 percent of the fillings in each bundle have the same shape as specified in the examples described above, each bundle may include substantially 90% or more of the specified fillings in combination with other fillings of different shapes. The toothbrush having such combination of fillings can achieve or exhibit a considerable cleaning capability and a soft feeling to gingivae. Also, the toothbrush having one or two rows of the filling setting holes arranged in the filling setting base can be effectively used for brushing boundaries between teeth and gingivae according to the Bass technique.

As can be seen from the foregoing, the toothbrush of the present invention includes the fillings which are made of a synthetic filament material and of which a length of the pointed tapered ends or tips, a maximum diameter of the non-tapered section, a diameter of the filling setting holes, and intervals between the filling setting holes are defined within specified ranges, respectively. Alternatively, the toothbrush of the present invention includes the fillings of which diameters of the pointed tapered tips at predetermined positions are defined within specified ranges. Such construction of the present invention permits the tips of the fillings to enter or reach areas such as recesses between teeth, boundaries between teeth and gingivae, and the like to effectively remove food debris, dental plaque and the like therefrom. Also, such construction results in the tips exhibiting a soft feeling sufficient to permit the toothbrush to be suitable for cleaning a periodontal pocket formed by a weakened gingiva. Thus, it will be noted that the toothbrush of the present invention effectively prevents periodontal diseases, as well as tooth decay.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A toothbrush comprising:

fillings made of a synthetic filament material, each of said fillings having two end tips including a tapered section at each end tip and a non-tapered section interconnecting said respective end tips, said fillings being gathered together into a plurality of bundles, wherein said fillings are each formed at both tips thereof into a pointed tapered section, and each of said bundles of said fillings is doubled over at a central portion thereof; and a handle provided at a distal end thereof with a filling setting base, said filling setting base being formed with filling setting holes in which a portion of said central portion of said bundles of said fillings are set so as to permit said end tips of each of said fillings to be outwardly projected therefrom, said filling setting holes being arranged in a plurality of rows in parallel to a longitudinal direction of said handle;

said pointed tapered end tip section of each of said fillings being formed with a length of 4 to 8 mm, said non-tapered section of each of the fillings being formed with a maximum diameter of 0.16 to 0.20 mm; and said end tips being positioned at approximately the same distance from the handle filling setting base and each of the bundles being spaced to provide a gap between adjacent bundles;

each of said filling setting holes being formed with a diameter of 1.5 to 2.0 mm and an interval between the edges of said holes being 1.0 to 1.2 mm in the longitudinal direction of said handle.

2. A toothbrush as defined in claim 1, wherein said tapered section of each of said fillings is formed with a length of 4 to 7 mm, said non-tapered section of each of said fillings is formed with a maximum diameter of 0.17 to 0.18 mm, and each of said filling setting holes is formed with a diameter of 1.5 to 1.9 mm and an interval between the edges of said holes is 1.0 to 1.2 mm in the longitudinal direction of said handle.

3. A toothbrush comprising:

fillings made of a synthetic monofilament material, each of said fillings having two end tips including a tapered section at each end tip and a non-tapered section interconnecting said respective end tips, said fillings being gathered together into a plurality of bundles, wherein said fillings are each formed at both end tips thereof in a pointed tapered section and each of said bundles of said fillings is doubled over at a central portion thereof; and a handle provided at a distal end thereof with a filling setting base, said filling setting base being formed with filling setting holes in which a portion of said central portion of said bundles of said fillings are set so as to permit said tip end of each of said fillings to be outwardly projected therefrom at approximately the same distance from said filling setting base, said filling setting holes being arranged in at least one row parallel to a longitudinal direction of said handle;

said tapered section of each of said fillings being formed into a shape defined by diameters of the tapered section of each of the fillings at distances of 1mm, 3 mm, 5 mm and 8 mm from a tip end of the filling, said diameters being set in the ranges of 25 to 35%, 55 to 70%, 80 to 90% and 90 to 100% of a diameter of a non-tapered section of the filling.

4. A toothbrush as defined in claim 3, wherein said fillings have a stiffness represented by calculated values from deflection forces at distances of 1 mm, 3 mm, 5 mm and 8 mm from the tip ends of said fillings, said calculated values being 0.5 to 2.0N/mm$^2$, 2.5 to 4.5N/mm$^2$, 3.5 to 5.5N/mm$^2$ and 6 to 15N/mm$^2$, respectively, as measured and calculated according to the International Standard ISO 8627.

5. A toothbrush as defined in claim 4, wherein said tapered tip of each of said fillings is formed with a length of 8 to 15 mm, said proximal section of the filling being formed with a maximum diameter of 0.15 to 0.25 mm, and each of said filling setting holes is formed with a diameter of 1.5 to 2.2 mm and spaced from other holes at an interval of 1.0 to 1.4 mm in the longitudinal direction of said handle.

6. A toothbrush comprising:

fillings made of a synthetic filament material, each of said fillings having an end tip including a tapered section at each end tip and a non-tapered section, said fillings being gathered together into a plurality of bundles; and a handle provided at a distal end thereof with a filling setting base, said filling setting base being formed with filling setting holes in which said non-tapered sections of said bundles of said fillings are set so as to permit said end tip of each of said fillings to be outwardly projected therefrom, said filling setting holes being arranged in a plurality of rows in parallel to a longitudinal direction of said handle;

said pointed tapered end tip section of each of said fillings being formed with a length of 4 to 8 mm, said non-tapered section of each of the fillings being formed with a maximum diameter of 0.16 to 0.20 mm; and said end tips being positioned at approximately the same distance from the handle filling setting base and each of the bundles being spaced to provide a gap between adjacent bundles;

each of said filling setting holes being formed with a diameter of 1.5 to 2.0 mm and an interval between the edges of said holes being 1.0 to 1.2 mm in the longitudinal direction of said handle.

* * * * *